US005836654A

United States Patent [19]

DeBellis et al.

[11] Patent Number: 5,836,654

[45] Date of Patent: Nov. 17, 1998

[54] WHEELCHAIR SEAT ASSEMBLY WITH CONTOURED SEAT PAN AND CUSHION AND METHOD

[75] Inventors: Pamela C. DeBellis; Grant C. Denton, both of Boulder; John C. Dinsmoor, III, Westminister; Richard R. Runkles, Longmont, all of Colo.

[73] Assignee: Sunrise Medical HHG Inc., Longmont, Colo.

[21] Appl. No.: 915,351

[22] Filed: Aug. 20, 1997

Related U.S. Application Data

[62] Division of Ser. No. 654,102, May 28, 1996.

[51] Int. Cl.[6] ..... A47C 27/18; A47C 27/14; A47C 7/02

[52] U.S. Cl. ..... 297/452.41; 297/452.55; 297/440.22; 5/654

[58] Field of Search ..... 297/452.25, 452.41, 297/452.61, 452.24, DIG. 4, 440.22, 452.55; 5/909, 653, 654

[56] References Cited

U.S. PATENT DOCUMENTS

| | | | |
|---|---|---|---|
| 2,380,102 | 7/1945 | Farmer | 297/452.24 X |
| 3,000,020 | 9/1961 | Lombard et al. | 5/653 |
| 3,987,507 | 10/1976 | Hall . | |
| 4,025,114 | 5/1977 | Cave | 297/452.55 X |
| 4,629,246 | 12/1986 | Fulton . | |
| 4,643,481 | 2/1987 | Saloff et al. . | |
| 4,699,427 | 10/1987 | Kobayashi | 297/452.61 X |
| 4,725,094 | 2/1988 | Greer | 297/188.06 X |
| 4,726,624 | 2/1988 | Jay . | |
| 4,753,480 | 6/1988 | Morell . | |
| 4,796,948 | 1/1989 | Paul et al. . | |
| 4,837,881 | 6/1989 | Kondo et al. . | |
| 4,930,171 | 6/1990 | Frantz . | |
| 4,951,334 | 8/1990 | Maier . | |
| 4,953,913 | 9/1990 | Graebe . | |
| 5,018,790 | 5/1991 | Jay . | |
| 5,074,620 | 12/1991 | Jay et al. . | |
| 5,088,747 | 2/1992 | Morrison et al. . | |

(List continued on next page.)

FOREIGN PATENT DOCUMENTS

| | | |
|---|---|---|
| 1337941 | 8/1962 | France . |
| 88 14 833 | 11/1988 | France . |
| 24 00 119 | 10/1975 | Germany . |
| 37 04 529 | 8/1988 | Germany . |

*Primary Examiner*—Peter M. Cuomo
*Assistant Examiner*—David E. Allred
*Attorney, Agent, or Firm*—MacMillan, Sobanski & Todd, LLC

[57] ABSTRACT

A seat assembly (21) for a wheelchair including a relatively rigid seat base (12) of substantially uniform thickness with an upwardly facing contoured top surface (14) and a cushion assembly mounted on the seat base. The cushion assembly includes a relatively soft foam member (30) substantially covering the seat base (12) for localized deformation of the foam member and for communication of the influence of contours on the seat base (12) through the foam member (30) to the user. In the preferred form, a flexible pouch (40) having a viscous fluid-like material contained therein is positioned in a recess (38) in the foam member (30) in the area of the user's ischial tuberosities and coccyx, and a water-impervious, flexible elastomeric envelope (50) completely surrounds the foam member (30) and the fluid-containing pouch (40). The fluid pouch (40) has a size greater than the plan area of recess (38) in the foam member (30) and is placed in a semi-collapsed condition in the recess so as to be displaceable without hammocking. Additionally, elastomeric envelope (50) has a sheet area greater than the area of the semi-collapsed fluid pouch (40) to ensure that the envelope (50) does not hammock under the user's weight. Finally, a hydrophobic cover (60) can be mounted over the cushion assembly and to the seat base (12). A method of supporting a user on a wheelchair seat assembly is also disclosed.

38 Claims, 4 Drawing Sheets

U.S. PATENT DOCUMENTS 5,092,655 3/1992 Degener et al. ..... 297/452.25
5,189,747 3/1993 Mundy et al. .
5,201,780 4/1993 Dinsmoor, III et al. ..... 5/909 X
5,333,921 8/1994 Dinsmoor, III ..... 297/DIG. 4 X
5,352,023 10/1994 Jay et al. ..... 297/452.41 X
5,378,045 1/1995 Siekman et al. .
5,395,162 3/1995 Jay et al. .
5,437,497 8/1995 Hutson .
5,441,676 8/1995 Bigolin ..... 5/909 X
5,490,299 2/1996 Dinsmoor, III et al. ..... 297/452.41 X
5,551,756 9/1996 Gurasich et al. ..... 297/440.22 X
5,556,168 9/1996 Dinsmoor, III et al. ..... 297/DIG. 4 X

WHEELCHAIR SEAT ASSEMBLY WITH CONTOURED SEAT PAN AND CUSHION AND METHOD

This is a division of application Ser. No. 08/654,102, filed May 28, 1996.

TECHNICAL FIELD

In general, the present invention relates to seat assemblies of the type which include a rigid seat base or pan with a cushion supported thereon and, more particularly, relates to seat assemblies for wheelchairs.

BACKGROUND ART

1. Wheelchair Seating System Design Considerations

Patients who are immobilized for any number of reasons are prone to develop pressure sores or decubitus ulcers. It is highly desirable to design wheelchair seating systems for such patients which minimizes this problem. The problem of pressure sores is especially severe at any point on the body where a load-bearing bone is positioned adjacent to an underlying support medium. Pressure sores are areas of necrotic tissue resulting from localized pressure concentration in an area of the body from prolonged contact with a chair or a bed. Patients who are victims of stroke, hip fracture, spinal cord injury, and head injury, as well as paraplegics and geriatrics using wheelchairs, are particularly susceptible to pressure sores.

The area in which pressure sores develop on the patient's body is very localized. It has been estimated, that when seated on a flat surface, up to 75% of a person's body weight is distributed over an area covering only four square inches, usually in the region of the ischia or seat bones. For a person weighing 150 pounds, this means as much as 110 pounds of pressure is distributed over just four square inches, or over 25 pounds per square inch. It has also been estimated that capillary blood pressure, when seated, is about 40 millimeters of mercury or about 0.8 pounds per square inch at these locations. If pressures higher than 40 millimeters of mercury are developed during sitting, the blood flow through the capillaries can be restricted. This restriction produces a much higher probability of the seated patient developing pressure sores.

In addition to pressure sores which result from pressure concentrations, many wheelchair seating systems are constructed in a manner producing shearing strain in the user's skin. This shear problem typically occurs when the patient's bones move relative to the patient's skin, for example, when the skin rests on a non-stretching seat surface and the patient's bones are shifted laterally relative to the stationary skin. Rubbing of the bones on the inside of the skin tissue can produce pressure sores, either alone or in combination with undesirable pressure concentrations. This problem is exacerbated when the patient has experienced muscle atrophy, since muscle tissue is no longer present to cushion relative movement of the bones and skin tissue.

Skin shear tends to exist whether or not a non-stretching wheelchair seating surface is contoured to match the body's shape. It is, however, much more pronounced when the non-stretching surface does not contour to the patient's body or when the non-stretching surface is pulled taught or hammocks under the patient's body. Hammocking is defined, as used herein, as a suspension of the bony prominences of the user or patient on the surface of a cushion or seat to thereby prevent total conformation of the cushion to the user's body, which in turn prevents complete pressure equalization.

Consequently, the need also exists to provide a seating system which, while anatomically contoured to the patient's body, also does not hammock or become pulled taught under the patient, thereby equalizing the support pressure and minimizing shear stresses on the patient's skin by allowing the skin to shift with or follow the patient's bones. Such seating systems will reduce the likelihood of pressure sore formation.

The successful treatment of pressure sores has typically required daily care and debridement for a period of many months. In some cases, surgical skin grafting is necessary. The problems and costs attendant to treating a single pressure sore are great, and therefore prevention of these sores must be considered a factor of prime importance in designing wheelchair seating systems.

The issue of seat-to-floor height is also a very important consideration in designing a proper seating system for wheelchairs. A common problem for wheelchair seat assemblies is that they are constructed in a manner which increases the seat-to-floor height, usually as a result of placing a pressure-relieving cushion on top of the existing wheelchair seat. Merely placing a bulky cushion under a wheelchair user, therefore, provides additional comfort at the expense of raising their seat-to-floor height. The issue of seat-to-floor height is very important to wheelchair users who are physically able to self-propel the wheelchair with their feet. These users need to self-propel their wheelchairs with one or both of their feet. Placing bulky cushioning under the seat of a wheelchair user raises their seat-to-floor height thus not allowing the user's feet to touch the floor or forcing the user to straighten their legs and lose their proper seating position in order to touch the floor. The straightening of the user's legs increases the difficulty of self-propelling the wheelchair. Raising the patient's seating height also can prevent the user from fitting underneath normal tables. Furthermore, some wheelchair cushions can be so large and heavy as to restrict the user's mobility and independence.

Consequently, there has been a long-standing need to provide a wheelchair seating system which provides the required comfort and support to the user, with particular emphasis on minimizing the formation of pressure sores, without excessively raising the patient's effective floor-to-seat height. Moreover, such comfort most preferably would be achieved while minimizing the bulk and weight of the wheelchair seating system.

2. Specific Prior Art Systems

Many prior art wheelchair seating systems are directed to only one or two of the problems above set forth. U.S. Pat. No. 5,074,620 to Jay, et al., for example, discloses a wheelchair seat system that is directed only to the problem of adjusting the height, pitch and roll of a wheelchair seat base or pan. U.S. Pat. No. 5,437,479 to Hutson is also directed solely to adjusting the height of a wheelchair seat. The issue of better weight distribution and the reduction of pressure concentrations in the ischia and coccyx areas is not directly addressed in either of these systems.

U.S. Pat. No. 5,088,747 to Morrison is illustrative of an approach which emphasizes pressure distribution at the expense of seat-to-floor height, bulk, weight and complexity. A vertically stacked assembly of a board-like support member, a foam member, a gel envelope and a second foam member are all placed on top of a standard wheelchair sling seat. This assembly is undoubtedly effective in reducing pressure concentrations, but its seat-to-floor height, bulk and weight are highly undesirable.

U.S. Pat. No. 4,953,913 to Graebe and sold under the trade name "ROHO" by Roho, Inc. of Belleville, Ill.

employs a combination of an anatomically contoured relatively thin rigid seat pan or base with a pneumatic, multi-celled seat cushion. The seat pan is mounted over a standard sling seat and cannot be mounted to a wheelchair independent of the existing sling-seat, and accordingly increases the seat-to-floor height somewhat. The pneumatic multi-celled cushion tends to be relatively effective in distributing pressure, but such cells are well known to lack the desired degree of lateral stability and have substantial height. Thus, the increased height and lateral instability problems remain in the Graebe seat assembly.

In U.S. Pat. No. 4,629,246 to Fulton, a wheelchair seat assembly is disclosed which has a mounting structure which overcomes the seat-to-floor problem. Thus, a seat pan or base is provided which is hung or dropped down below the wheelchair seat-supporting frame members to accommodate a bulky, soft, seating cushion while maintaining the original seat-to-floor height. The seat base is notched to avoid interference with wheelchair componentry, particularly the folding cross-members. Thus, pressure distribution is accomplished while maintaining the seat-to-floor height, but these goals are met at the expense of bulk, and the seating assembly does not provide for shear force reduction on the patient's skin.

A variety of wheelchair seat assemblies exist, however, which have modified the shape of the support cushion or padding of the wheelchair seat from the Fulton-type rectangular block to a more anatomically-shaped surface. The design of these anatomically contoured cushions acts to better distribute user weight and to provide the user with additional stability.

One example is found in U.S. Pat. No. 4,643,481 to Saloff, et al. which discloses a two-piece seat base formed with an anatomically contoured upper surface. A composite foam and fluid cushion is placed over the seat base. Both the base and the cushion are formed in the shape of a pair of wings surrounding a void over which the user's ischia and coccyx are to be positioned. The fundamental approach of this design is to relieve the pressure under the seat bones by redistributing it to the surrounding areas of the buttock and thighs. Unfortunately, this structure does nothing to support the user's ischia bones and coccyx, and its design may well serve to increase the shearing forces on the patient's skin. The user's seat-to-floor height, and the weight and bulk of the seat assembly, clearly are increased.

Another approach is to provide cushions with materials of different resiliency positioned at various areas under the seating area of the patient such that more support is provided at certain anatomical locations. U.S. Pat. No. 4,951,334 to Maier and U.S. Pat. No. 4,837,881 to Kondo, et al. both disclose seat cushions having portions with differing compression characteristics. Another similar type of seating cushion is described in the 1982 Vasio "PARA" Cushion Brochure of Preston Corporation of Clifton, N.J. The assembly of the Maier patent is not anatomically contoured, and positions the ischial bones and coccyx over a void (as was similarly found in the Saloff et al system discussed above); it provides no support whatsoever to this important region. Whereas the Maier, Kondo and "PARA" cushions all provide for greater rigidity and therefore support at critical anatomical locations, none of these systems addresses the problems which they create by employing greater cushion thickness, namely, the raised seat-to-floor height problem and additional bulk and weight.

In U.S. Pat. No. 3,987,507 to Hall, a three-layer foam cushion is employed which has three round foam inserts of lower density than the surrounding foam which is placed into recesses in a central foam layer. U.S. Pat. No. 4,753,480 to Morrell also discloses a foam pad having cutout sections wherein inserts of lower density are placed. Both of these patents do provide additional support around the critical ischial and coccyx anatomical areas; however, being large foam sandwiches, they do not solve the problem of added seat-to-floor height, nor bulk and weight problems.

Various wheelchair seating assemblies also exist which provide cushioning using fluid or air-filled pouches specifically positioned to support the patient's ischial area. For example, U.S. Pat. No. 4,796,948 to Paul, et al. discloses a support system for a wheelchair wherein an inflatable support bladder is located directly under the patient's ischial tuberosities. This support bladder is normally deflated whereby only minimal support pressure exists on this ischial area; however, a fluid may be supplied to inflate the support bladder causing a much greater proportion of the patient's body weight to be supported by this inflatable pouch. By alternating between high and low levels of inflation in the bladder, the patient's weight can be periodically redistributed, away from and back to the patient's ischial tuberosities, thereby combating the formation of pressure sores.

U.S. Pat. No. 4,930,171 to Frantz discloses a fluid-filled bladder imbedded into a foam pad. This bladder is positioned directly under the patient's ischial area. However, the area under the coccyx is not supported at all since both the foam and fluid parts of the cushion are cut out in this region. Since both Paul and Frantz employ a single compartment bladder in which the fluid or air moves freely, both Paul and Frantz are subject to excessive migration of the fluid, which can cause bottoming out of the user on the bladder as the fluid moves and the patient's weight is shifted from side-to-side.

Cushion assemblies also exist in which a fluid-filled envelope covers the entire surface of a relatively rigid and anatomically contoured foam tray. U.S. Pat. No. 4,726,624 to Jay, for example, discloses a seat assembly having a fluid envelope covering a shaped, semi-rigid, foamed tray.

This tray is shaped with a recess in the ischial coccyx area. The fluid pad is divided into two compartments which cover the entire tray. The tray has side rims which are sloped downwardly from the outer edge toward the ischial coccyx area recess thus urging the thixotropic fluid material in the envelope to flow toward this depressed area. U.S. Pat. No. 5,018,790 to Jay and U.S. Pat. No. 5,378,045 to Siekman, et al. both disclose seat cushions having similarly formed fluid-filled envelopes. The two Jay systems do not address the problem of raised seat-to-floor height of the patient, and fluid bladders which cover the entire seating tray tend to add undesirable weight to the seat assembly.

A system sold under the trade name "AKROS" is manufactured by Akros Manufacturing Inc. of Cloversville, N.Y. This system is composed of a fluid pouch substantially covering a rigid seat base. The fluid pouch is cut away similar to the Maier patent, such that the ischial tuberosities and coccyx are positioned over a void and receive no support.

U.S. Pat. No. 5,395,162 to Jay discloses a wheelchair seat assembly in which a fluid-filled pad is positioned over a contoured tray or cushion. This assembly does not include a seat base nor is any teaching included as to dropping the seat cushion or tray to maintain seat height. A compartmentalized pad, however, is shown which can extend over the entire area of the cushion or only the ischial-coccyx region.

Finally, a prior art wheelchair seat assembly employs a chambered fluid filled insert in a foam seating pad of a wheelchair cushion. U.S. Pat. No. 5,189,747 to Mundy, et al. discloses a seat cushion having a flat, relatively rigid "internal" base or pan on which a shaped foam cushion is supported. The internal seat pan, in turn, is mounted on another or external rigid base or seat pan, which includes mounting clips for mounting the assembly in a dropped position to accommodate the relatively bulky cushion assembly. This foam cushion assembly is formed with a recess or pocket to receive an insert which can take the form of either a visco-elastic foam or a fluid pouch. The insert is stuffed or accordion folded into the cushion recess or pocket. If a fluid filled pouch is used, it contains three chambers for the ischial tuberosities and the sacral or coccyx region. The limitation with this system is that, while it provides a fluid pouch support in the critical ischial and coccyx regions, the provision of anatomical support over the rest of the seat assembly is achieved by a bulky combination of shaped foams of differing density. Moreover, the double seat base or pan construction undesirably increases the seat assembly's weight.

3. Objects of the Invention

Accordingly, it is an object of the present invention to provide a seat assembly for a wheelchair which is highly effective in distributing the user's weight over the seat area, provides a highly stable support platform enhancing self-propelling of the wheelchair, provides even, low-pressure support in the ischial-coccyx region, does not materially increase the seat-to-floor height, and has a relatively low weight and bulk.

It is another object of the invention to provide a comfortable wheelchair seating assembly that relieves the pressure placed on each of the patient's ischia bones and coccyx by providing additional separate isolating support in these three critical anatomical areas.

It is a further object of the invention to provide a wheelchair seating system that can be used to replace a sling-type seat without substantially raising the patient's seat-to-floor height such that the user's mobility would be impaired.

It is another object of the invention to provide a wheelchair seating system that will reduce shear forces on the patient's skin, as well as shift the distribution of the person's weight away from the ischial tuberosities and coccyx.

It is a further object of the invention to provide a wheelchair seating assembly that has a surface that is anatomically contoured to a human patient's body for better weight distribution and increased lateral stability.

It is a further object of the invention to provide a thin, rigid, anatomically-contoured seat base with a mounting structure adapted for removably mounting said seat base to seat-supporting frame members of a wheelchair.

It is a further object of the invention to provide a method for positioning a flexible fluid filled pouch which provides support for a user's ischial tuberosities and coccyx, with the flexible pouch held in position in a recess of a soft foam member without being fastened to the soft foam member and in particular, avoiding the use of any hook and loop fasteners between the foam member and the flexible pouch.

It is a further object of the present invention to provide a seat assembly constructed to reduce shear stresses by maintaining the surface of the elastomeric envelope enclosing the seat components in a loose condition preventing hammocking.

It is a further object of the invention to provide a wheelchair seating assembly that does not interfere with the mounting hardware, folding cross-bars and componentry of a typical folding wheelchair to enable its retrofitting to a wide variety of wheelchairs.

It is a further object of the invention that the weight of the seating assembly be kept to a reasonable minimum thus not impairing the user's mobility.

It is a further object of the invention to provide a moisture and odor barrier between the user and the supporting cushioning material in the seating assembly, and to provide a wipeable and easily cleanable surface that acts as a moisture and odor barrier.

The wheelchair seating system of the present invention has other objects and features which will become apparent from and are set forth in more detail in the accompanying drawing and the following description of the Best Mode of Carrying Out the Invention.

DISCLOSURE OF INVENTION

The wheelchair seating system of the present invention is composed, briefly, of an anatomically contoured relatively rigid seat base, a flexible fluid filled pouch, an anatomically contoured foam member, and an anatomically contoured elastomeric envelope wrapping around and covering said foam member and said flexible pouch.

The relatively rigid seat base includes a mounting structure adapted for mounting said seat base to seat-supporting frame members of a wheelchair. The seat base is further formed to extend below the frame member over substantially an entire width dimension of said seat base, so as to drop or lower the seat assembly and maintain a seat height facilitating propulsion of the wheelchair. The seat base advantageously may be formed from a relatively thin sheet of material having an upwardly facing contoured top surface, such as an aluminum sheet which is anatomically contoured to distribute the user's weight more evenly and to laterally stabilize the user while seated on the seat assembly. The anatomically contoured top surface of the seat base preferably has an upwardly facing convexed abductor region proximate a front edge thereof, a scalloped front edge on each side of the abductor region, a lower region under the user's buttocks and a relieved back edge.

The flexible fluid pouch of the present seat assembly contains a viscous fluid, and the pouch is mounted inside, and is anchored to, the elastomeric envelope. The flexible pouch preferably is divided into three compartments each containing a viscous fluid therein, and the pouch has a configuration positioning one of the compartments under each of the ischial tuberosities of the user and one of the compartments under the coccyx of a user seated thereon. The compartments are sealed from each other to prevent migration of the viscous liquid from one compartment to another.

The elastomeric envelope of the present seat assembly is formed, preferably by thermo-forming, to have an area in the user's ischial/coccyx region which is sufficiently greater than such region to prevent hammocking of the user's bony prominences on the elastomeric envelope. The bottom side of said elastomeric envelope has at least one air vent which is preferably composed of a layer of breathable maternal contained between layers of elastomeric material.

A foam member, which preferably is relatively soft, also is contained within the elastomeric envelope, the soft foam member being sufficiently soft and flexible for localized, deformation of the foam member under a user seated thereon. The soft foam member can have a recess therein located proximate a rear edge of the foam member to receive the ischial/coccyx region of a user seated on the seat assembly. The flexible pouch is received in the recess and is larger than the recess so that it can be placed in the recess in a semi-collapsed condition which prevents hammocking.

A hydrophobic fabric cover may be placed over the cushion assembly to enable air circulation between the user and cushion for added comfort.

The combination of a relatively rigid, contoured, sheet-like seat pan, a relatively soft foam cushion, and a flexible fluid pouch surrounded by an elastomeric envelope, reduces pressure concentrations and skin shear by providing low pressure support under bony prominences and allowing the user's skin to follow shifting of his or her bones. The seat assembly, however, also provides lateral stability, while still maintaining substantially the same seat-to-floor height and a relatively low weight and bulk.

BEST MODE OF CARRYING OUT THE INVENTION

The present invention provides a low-profile, comfortable seating system for wheelchairs with additional needed support around the region of the ischial tuberosities and coccyx. The seating system is based upon the use of a relatively rigid sheet-like seat pan which is anatomically contoured and preferably used in combination with a relatively soft foam cushion. A still softer foam insert, or fluid pad insert, preferably is provided in the region of the ischial tuberosities and coccyx. The soft foam cushion member allows the user to sink into the foam in a manner increasing the contact area and distributing the pressure, while the rigid underlying seat pan provides the necessary anatomical reinforcement of the cushion contours so as to laterally stabilize the user on the soft cushion. Additional low pressure support is provided in the ischial/coccyx region by the very soft foam insert or a fluid pouch.

The thin nature of the seat pan, as well as its concaved configuration allows the pan to be placed on top of the wheelchair frame members, once the sling upholstery is removed, and to immediately curve down below the frame members so that the overall seat-to-floor height of the seat assembly is not substantially altered from that of a conventional sling seat. The concaved configuration of the seat pan also provides a stabilizing contour proximate the edges of the seat which combines with a central abductor region contour to provide a high degree of lateral stability.

Figure 1:
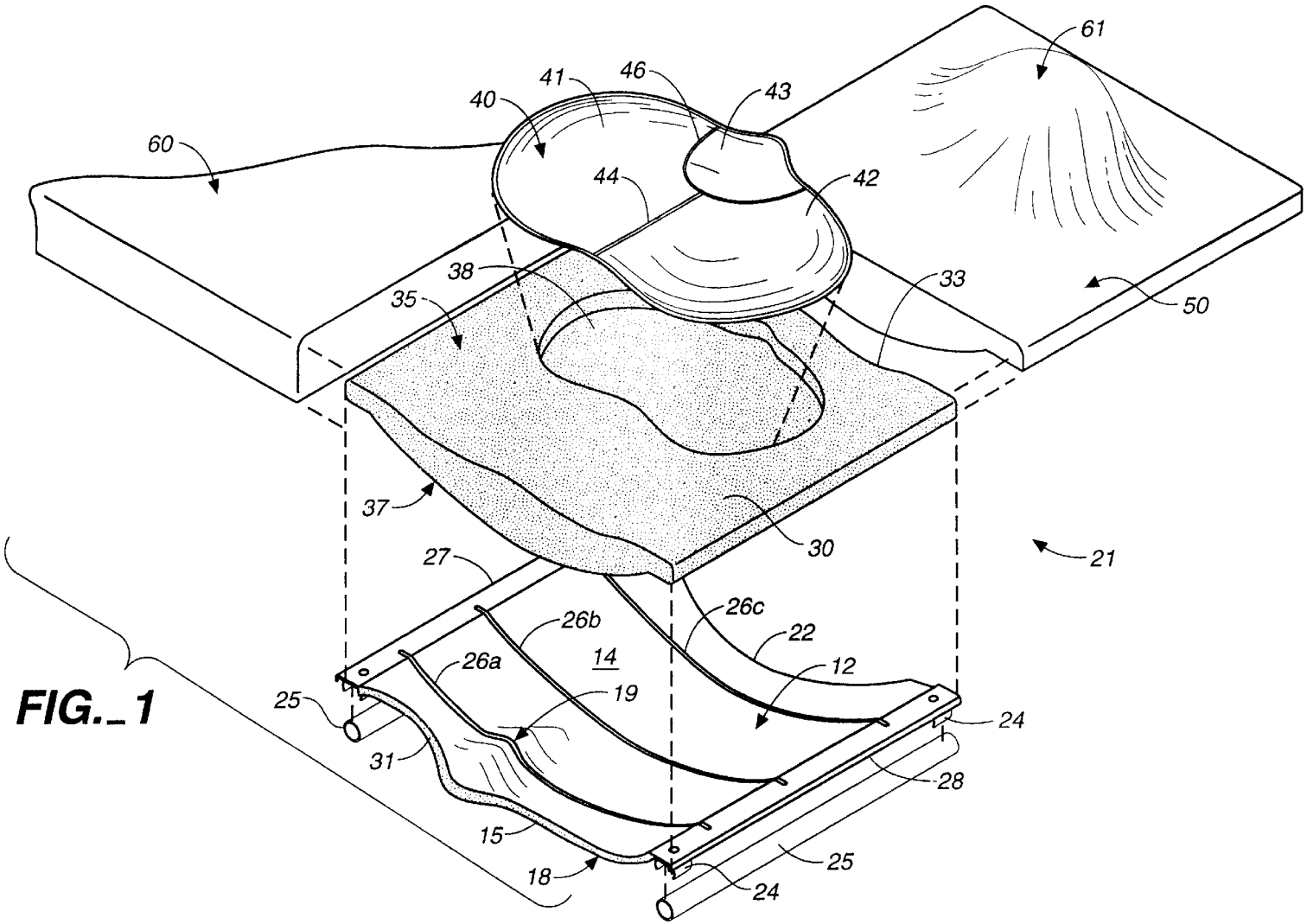
FIG. 1 is an exploded top perspective schematic view of a wheelchair seat assembly constructed in accordance with the present invention.

Referring now to FIG. 1, the seat assembly of the present invention, generally designated 21, can be seen to be comprised of a relatively rigid seat pan or base 12, and a cushion assembly in the form of a foam member 30, preferably having a recess or pocket 38 therein which receives a fluid pouch 40. Foam member 30 substantially covers the entire area of seat base 12, and in fact overlaps a front edge 18 and a rear edge 22 of the seat base in a manner described below. Mounted over foam member 30 and pouch 40 is a water-impervious elastomeric envelope 50, which protects the foam member from the absorption of liquids. Finally, seat assembly 21 preferably includes a hydrophobic fabric cover 60, which may take the form of a shower-cap type cover. Cover 60 is mounted over envelope 50 and around the edges 27 and 28 of seat pan 12 to provide a more comfortable interface between the user and the wheelchair seat assembly.

In order to provide a low-profile seat assembly which maintains the seat-to-floor height at about the same height as a standard sling seat, seat assembly 21 of the present invention preferably includes a very thin and yet relatively rigid and strong seat base or pan 12. As best may be seen in FIG. 2, seat base 12 may advantageously be formed of a relatively thin sheet of material, most preferably a metal such as aluminum, which has a high strength-to-weight properties. The seat base is preferably removably mounted by mounting clips 24 on top of wheelchair frame members 25 in place of, and after removal of, the standard sling seat and mounting hardware provided by most wheelchair manufacturers. It will be understood, however, that the present seat assembly also can be provided as original equipment on the wheelchair and can be permanently, not removably, mounted to frame members 25.

Figure 2:
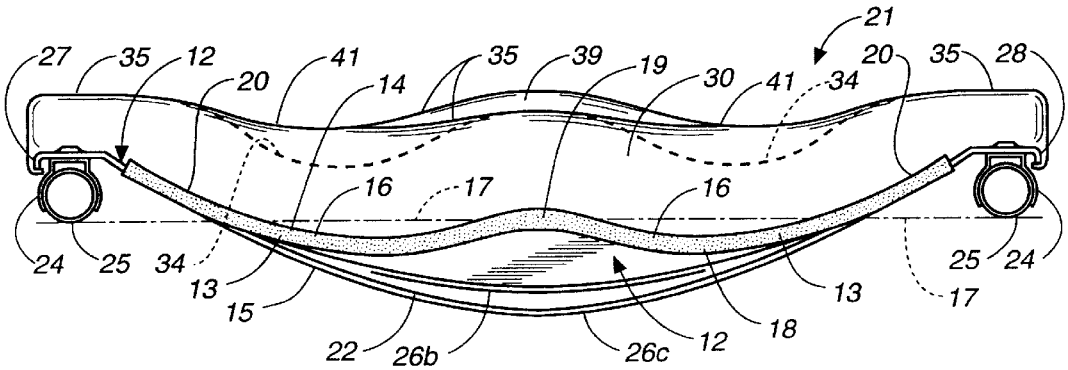
FIG. 2 is an enlarged, front elevation view of the seat assembly of FIG. 1 shown mounted on wheelchair frame rails with the seat cover and water-impervious envelope removed.
Figure 6:
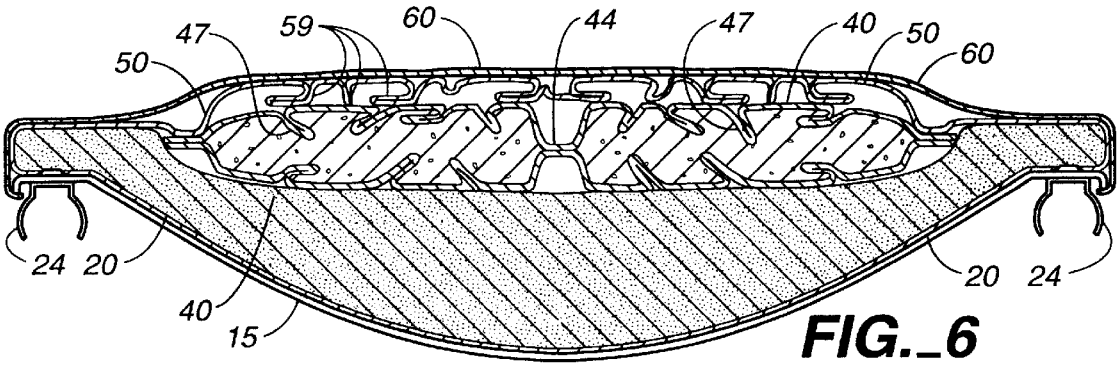
FIG. 6 is a front elevation view, in cross section, taken substantially along the plane of line 6—6 in FIG. 3.
Figure 7:
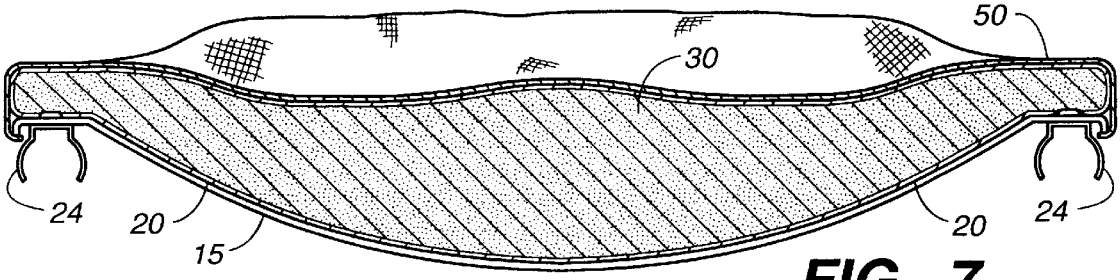
FIG. 7 is a front elevation view, in cross section, taken substantially along the plane of line 7—7 in FIG. 3.

As will be seen in FIG. 2, 6 and 7, seat pan 12 has a generally upwardly facing concaved top surface 14 and a downwardly facing convex bottom surface 15. This configuration allows the seat base to drop quickly closely adjacent frame members 25 to a position below a plane 17 (FIG. 2) at the bottom of seat-supporting frame members 25. Thus, closely proximate frame members 25, base 12 falls below plane 17, and the base is configured so that a majority of the width dimension of seat base 12 is positioned below plane 17 and below frame members 25. Seat pan or base 12, therefore, most preferably is more concave than a typical sling seat so that most of the width of seat cushion 30 on which the user sits will be supported by seat base 12 at positions well below frame members 25. This obviously reduces the seat-to-floor height of assembly 21 over most of its width and does so without requiring a notched cushion or a notched seat base. The wheelchair folding mechanism will not interfere with mounting seat assembly 21 to the wheelchair and visa versa, although seat assembly 21 most typically will be removed before folding of the wheelchair to a collapsed condition.

In addition to being concaved so as to drop the seat height, relatively rigid seat base 12 further is preferably anatomically contoured on its top or upwardly facing surface 14. Thus, proximate the front edge 18 of base 12 there is an upwardly convex region 19 which acts as an abductor supporting surface for the seat assembly. Abductor region 19 defines, with downwardly sloping sides 20 of the seat pan, two upwardly facing valleys or recess portions 16, which are positioned to support the user's thighs. Proximate rear edge 22 of seat base 12, the seat base is formed to be downwardly curved to a deeper depth than proximate front edge 18. This provides relief in the area of the region of the user's buttocks. Finally, an inward scallop 22 at the back edge of pan 12 provides relief in the region of the coccyx.

An important feature of the seat pan portion of the assembly of the present invention is that pan 12 preferably is formed of a relatively thin sheet of material of substantially uniform thickness which is stiffened by transversely extending ribs 26*a*, 26*b* and 26*c*. The use of a thin sheet maintains a low profile and weight, while ribs 26*a*–26*c* ensure that various contours in surface 14 do not disappear under loading. The contours in upper surface 14, therefore, will influence and, in effect, be transmitted through foam cushion 30 to the user to stabilize and influence the seating of the user, in a manner which will be described in more detail hereinafter.

The sheet of material used to form base 12 can be provided by a plastic, fiber-reinforced resin, or metal sheet of material. It should be of a size sufficient to span across the distance between frame members 25 and should have sufficient strength and rigidity, as supported on frame members 25, to act as the sole support for a user seated thereon. Normally, as above noted, the sling seat or other seating assembly on the wheelchair will have been removed, and while the seat cushion can support some bending load, such additional support will usually be nominal. Thus, pan 12 is the structural member which must support the user's weight.

In the preferred form, base sheet 12 is provided as 5052 alloy aluminum in a thickness of about 0.030 inches to about 0.200 inches, preferably 0.060 to 0.125 inches, with ribs 26*a*, 26*b* and 26*c* having a depth of about 0.20 inches. Seat base 12 can be formed from a flat sheet of aluminum which is then swaged or press-formed to form an anatomically contoured top surface 14. It should be noted, however, that the ribs are the same height over their length so that substantial deformation of the sheet is not required. In fact, downwardly facing surface 15 and ribs 26*a*–26*c* are also contoured in the same manner as upper surface 14. This facilitates manufacture of base 12 and maintains the low profile. As will be seen in FIG. 3, ribs 26*a*–26*c* extend from substantially one side of the base to the other, and it is preferable to downwardly deform opposite side edges 27 and 28 of base 12 to further stiffen the base and provide rounded edges which will minimize the likelihood that the user can inadvertently be injured or snagged on the edges of the base.

It is further preferable that the seat pan or base 12 of seat assembly 21 be scalloped at 31 along the front edge 18 at either side of central abductor region 19 of the seat pan so as to provide relief under the user's knees for the user's thighs. As will be seen in FIG. 3, foam member 30 extends forwardly of scallops 31, and a rubber or plastic edge extrusion 13 can be provided on front edge 18 to further provide a rounded edge which will not cut into the cushion or user's legs. Since the foam member is relatively soft and resiliently displaceable, the front edge 32 of foam member 30 can be easily resiliently displaced in a downwardly and rearwardly towards scallops 31 and edge extrusion 13 by the user's legs during propulsion of the chair by the user.

In order to provide pressure relief in the area of the coccyx, it is preferable that rear edge 22 of seat pan 12 similarly be formed with an arcuate inward scallop of a depth sufficient to relieve pressure under the coccyx. As will be seen, foam pad 30 has a rear edge 33 which extends rearwardly of the relieved back edge 22 so as to provide at least some resilient support. An edge extrusion can be provided along edge 22 but is not shown in the drawing.

Unlike many prior art wheelchair seat assemblies, the seat assembly of the present invention most preferably does not employ a relatively stiff, or rigid, shaped foam tray on top of seat base 12. Instead, foam member 30 in the seat assembly of the present invention is preferably a relatively soft foam member, being sufficiently soft and flexible for localized deformation of the foam member under the weight of a user seated on the assembly. Moreover, the seat is sufficiently soft that the contours on upwardly facing top surface 14 are communicated through the cushion foam 30 to a top surface 35 of the foam member, and thus to the user. Soft cushion 30 does not bridge or hammock across the contours on top surface 14 of pan 12.

In the preferred form, foam member 30 is a high resiliency polyurethane foam which has a softness that measures less than 100 lbs using the Indention Load Force Deflection (I.L.D.) test at 25% over 50 square inch area (ASTM D357), and most preferably the I.L.D. is about 20 lbs at 25% to about 60 lbs at 65%. The density of foam member 30 will be less than about 10 pounds per cubic foot, and preferably in the range of about 3 to about 5 pound per cubic foot. The low density and low I.L.D. of foam member 30 have several effects. First, the low density ensures that the seat assembly has a relatively low weight. Second, the low I.L.D. allows the user to sink into the foam to a substantial degree. As shown in FIG. 2, for example, the user's thighs can compress the soft and flexible foam member 30 to the dotted line position 34. The surface area contacted and supported by foam member 24 is thereby increased over that of relatively hard, inflexible foams so as to better distribute the user's weight and reduce the likelihood of the formation of pressure sores.

Additionally, as the user sinks into soft foam member 30, he or she becomes more laterally stable. This increased stability is enhanced by the contoured nature of top surface 14 of the seat base. The combination, for example, of downwardly sloping sides 20 of the seat pan and upwardly sloping sides of abductor region 19 gives the user a high degree of lateral stability which is important to propelling the wheelchair and maintaining a good pelvic position while sitting in the wheelchair. The increased immersion of the user into foam member 30 also aids in the user's ability to touch the floor and consequently, to self propel the wheelchair.

In the most preferred form, foam member 30 is not only soft and flexible, but the upper surface 35 and the lower surface 37 also are also contoured. Lower surface 37 preferably is contoured to substantially mate with anatomically contoured, upwardly facing surface 14 of the seat base. The upper surface 35 of foam member 30 most preferably includes an abductor upward protruding area 39 proximate a front edge of the foam member, as well as concaved areas or valleys 41 proximate the front edge to receive and support the thighs. These anatomical contours compliment or augment the contours of surface 14 on base 12, and they cooperate with the base contours to effect reinforcement of the stability of the user as seated, even on a relatively soft, weight-distributing foam.

While in the most preferred embodiment foam member 30 is soft, it also is possible to use seat pan 12 with a foam member which takes the form of a rigid foam of the type used, for example, in the foam tray of U.S. Pat. No. 4,726,624. In such embodiments, the lower surface 37 of rigid foam member 30 would be contoured to substantially mate with contoured top surface 14 of seat base 12. Most typically a fluid pouch would be positioned over substantially the entire area of the rigid tray or foam member 30. This approach increases the weight of seat assembly 21, but this effect can be reduced by using light-weight fluids in the fluid pouch.

Figure 6A:
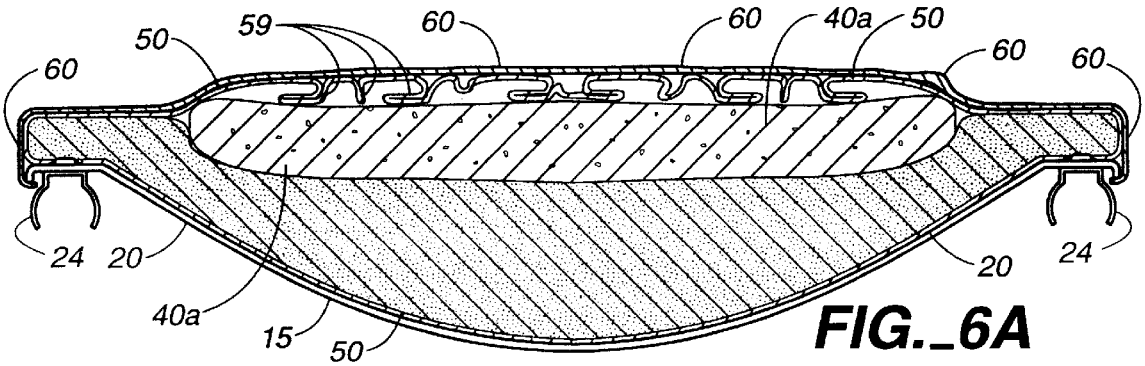
FIG. 6A is a front elevation view, in cross section, corresponding to FIG. 6 and showing an alternative embodiment of the seat assembly of the present invention.

Returning to the preferred embodiment, proximate a rear edge 33 of foam member 30 is a recess 38 which is positioned in foam member 30 in a region which will support the ischial tuberosities and coccyx of the user when seated on seat assembly 21. Recess 38 can take the form of a generally oval-shaped recess which varies in depth from about one-half inch proximate the sides to about one and one-quarter inches proximate the center line of the foam cushion. An insert is mounted in recess 38. The insert may take the form of a foam insert member 40*a* (as shown in FIG. 6A), which is even softer than foam member 30, or, more preferably, a flexible pouch 40 in which a fluid-like material, such as a viscous thixotropic fluid or flowable mixture of microballoons and lubricant, is contained. Such fluid pouches are well known in the wheelchair seating industry and are described in more detail in U.S. Pat. Nos. 4,726,624, 5,189,747 5,395,162 and 5,378,045, which are incorporated herein by reference. The details of such microballoon-based fluid-like materials will not be restated herein, other than to note that they are highly effective in providing low pressure support, which is extremely beneficial in the area of supporting bony prominences. One of the substantial disadvantages of such thixotropic fluids, however, is the added effect of their weight. Accordingly, in the preferred seat assembly of the present invention, while the entire seat pan 12 is covered by a relatively lightweight foam member 30, only the critical ischial/coccyx region 38 is provided with a more dense fluid pouch 40.

In the most preferred form, fluid pouch 40 is formed with three compartments 41, 42 and 43, although it also is possible to have three separate side-by-side pouches 41, 42 and 43. These compartments or separate pouches are preferably sealed from each other at seals 44 and 46 and are sealed at the periphery, for example, by heat sealing the polyester polyeurethane membrane which may be advantageously used to form pouch 40. By sealing compartments 41–43 from each other, or by using separate pouches, the possibility of migration of the supporting fluid from the individual compartments is eliminated. Interconnected compartments in which fluid is free to migrate from one compartment to another have been used, but they can result in bottoming-out. Accordingly, in the present seat assembly, it is preferred that the possibility of migration of the support fluid from underneath the critical bony protuberances be eliminated.

Pouch assembly 40 is preferably substantially oversized as compared to recess 38, as can be seen from FIG. 1. Fluid pouch 40 is not filled to capacity, and it therefore can be squeezed into a semi-collapsed condition when placed in recess 38. This results in a plurality of wrinkles 47 (FIGS. 3 and 6) in pouch 40 which allow the user's ischia and coccyx to sink into the pouch without hammocking. Wrinkles 47 further allow lateral shifting of the user's skin to follow shifting of the user's bony prominences. As may be seen in FIG. 6, the semi-collapsed pouch 40 can rise above the level of the top of foam member 30 providing support to the user's ischial bones and coccyx. The larger size of the pouch as compared to the foam recess 38, therefore, allows the upper surface of the pouch to shift vertically and laterally to accommodate pressure distribution and shifting of the user. This minimizes skin shear on the user as a result of pressure concentrations and lateral shifting. This semi-collapsed condition of the pouch, of course, also cooperates with the relative shear-free nature of a thixotropic fluid which is inside the pouch to provide added comfort.

Alternatively and in order to provide support of the user's ischial/coccyx region while minimizing weight and cost, seat assembly 21 can employ a resiliently flexible foam insert 40*a* (FIG. 6A) instead of a fluid pouch 40. Foam member 40*a* would advantageously be formed of a foam having an I.L.D. less than surrounding member 30, for example, below 20 lbs at 25% over 50 square inches so as to permit the user's bony prominences to sink into the insert for pressure equalization while still providing some support pressure in this region. Alternatively, foam insert 40*a* may be a visco-elastic foam which also has a softness less than the surrounding foam member 30 and sufficiently slow recovery to permit the user to lift up slightly from the insert and shift laterally before the foam insert returns to its full height.

While the combination of a soft foam and contoured rigid seat pan produces a highly desirable weight distribution and support, as well as good stability, it is further preferable that the seat assembly of the present invention have an additional structure which protects the foam and further reduces skin shear. Thus, mounted over foam member 30 is an elastomeric sheet, preferably in the form of an envelope 50, best seen in FIGS. 1 and 3.

Elastomeric envelope 50 preferably is substantially water-free impervious in order to protect foam member 30, and foam insert 40*a*, against the entry of moisture into the foam. Perspiration, urine and spilled liquids, are all commonly encountered problems which will tend to degrade wheelchair cushion foams. Envelope 50, therefore, protects foam members from contamination and physical break-down as a result of prolonged contact with such liquids.

Equally important, however, elastomeric sheet or envelope 50 provides for additional reduction in skin shear. As above described, the ischial/coccyx region of a user of seat assembly 21 will be supported on foam member 30 by a foam area substantially equal to the plan area of recess 38. In the preferred form, a fluid pouch 40 is placed in recess 38 in a semi-collapsed condition so that the pouch has a pouch area superimposed over foam area 38. As above noted, the pouch is larger than recess 38 and is semi-collapsed so that it has wrinkles 47 that permit the pouch to be laterally and vertically shifted without hammocking of the pouch.

It is an important feature of the present invention, therefore, that the moisture barrier sheet or envelope 50 have a sheet area 61 superimposed over foam area 38 and pouch area 40 which also is substantially greater than the area of the pouch in the semi-collapsed condition and the area of the foam which supports the ischial/coccyx region. Thus, elastomeric sheet/envelope 50 may be thermo-formed to provide a bulge 61, or inwardly or outwardly protruding sheet area 61, which is positioned over pouch 40 and recess 38 and which sheet area 61 is wrinkled at 59 (FIGS. 3, 6 and 6A) when the thin flexible elastomeric sheet is collapsed down onto supporting pouch or foam insert of the seat assembly. This structure prevents hammocking of envelope 50 relative to foam members 30 and 40*a* in the FIG. 6A embodiment, and prevents hammocking of sheet 50 relative to fluid pouch 40 and foam member 30 in the preferred embodiment. In the preferred embodiment, therefore, both pouch 40 is wrinkled at 47 and elastomeric envelope 50 is wrinkled at 59. The user can sink into the combination for better conformance and better pressure distribution. Additionally, the user can shift transversely (side-to-side or fore and aft) and shifting of the user's skin can be accommodated to follow shifting of the user's bony prominences by lateral shifting of both pouch 40 and elastomeric envelope 50. In the FIG. 6A embodiment, the wrinkles 59 in envelope 50 similarly ensure that the protective envelope is not a source of hammocking.

Figure 3:
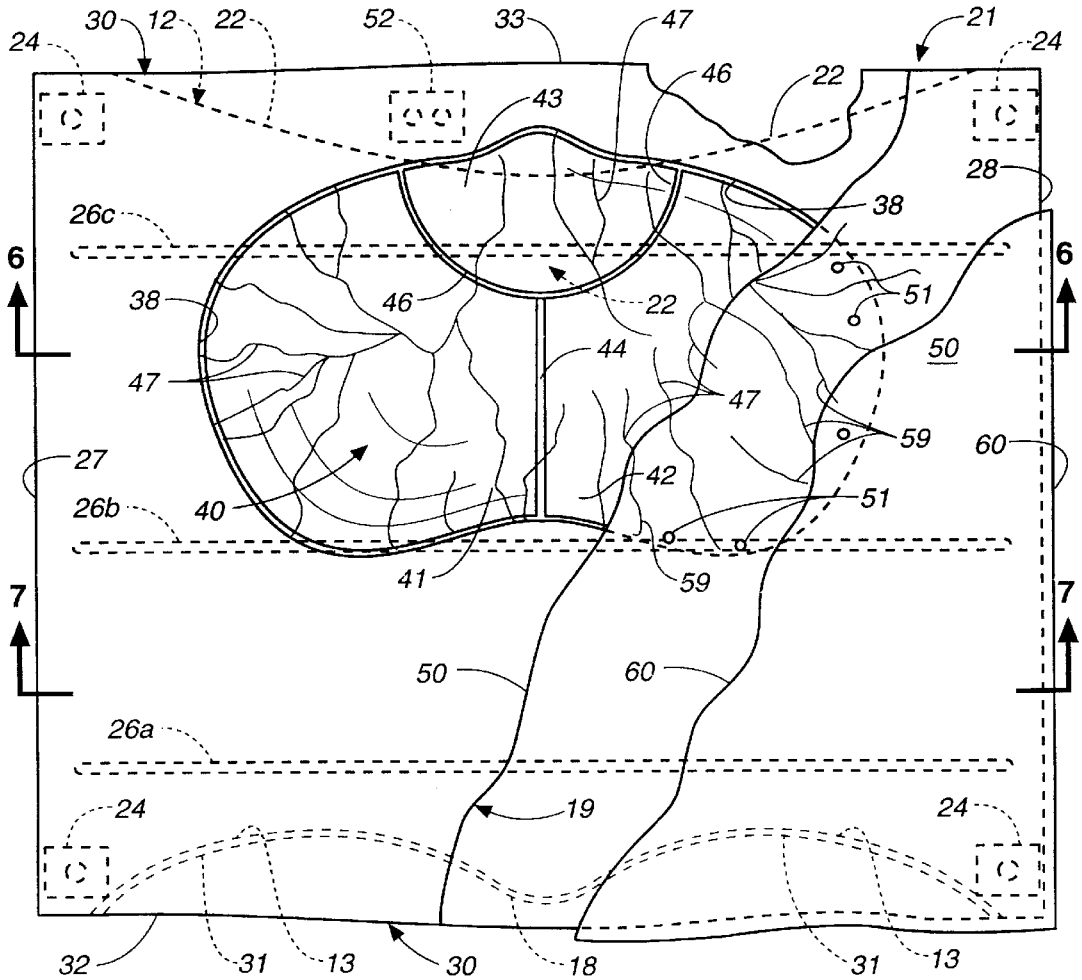
FIG. 3 is a top plan view of the seat assembly of FIG. 2 with portions thereof partially broken away for ease of understanding.

Another important feature of sheet or envelope 50 is that it may be used to secure fluid pouch 40 against transverse displacement (side-to-side or fore and aft). Fluid pouch 40 may be secured to the inside of envelope 50. Attachment preferably is accomplished at the periphery of enlarged sheet area or bulge 61, and at the periphery of pouch 40 so as not to impede the ability of these two members to shift transversely in the ischial/coccyx region. Such attachment will minimize relative displacement between fluid pouch 40 and envelope 50. It is preferred that envelope 50 be relatively snug and contoured to fit foam member 30, which ensures that pouch 40 will remain in substantially the same transverse relationship to the foam cushion member. As attached to envelope 50 and resting in recess 38, therefore, fluid pouch 40 need not be directly connected to foam member 30, for example, by hook and loop fasteners as has conventionally been done. Rather fluid pouch 40 will be anchored in position solely by its attachment to envelope 50 at a plurality of locations, for example by heat sealing at 51 (FIG. 3). If a plurality of pouches 41, 42 and 43 are used, they each may be secured to envelope 50 for example by heat sealing.

In the most preferred form, envelope 50 is provided by a thermoplastic, polyether polyurethane film having a thickness in the range of about 0.003 to 0.020 inches, and most preferably about 0.008 inches. Moreover, envelope 50 may be thermo-formed to be contoured along the top and bottom surfaces to match the contours of foam member 30, and to provide bulged sheet area 61. Such contouring of envelope 50 may be seen in FIG. 1.

Figure 4:
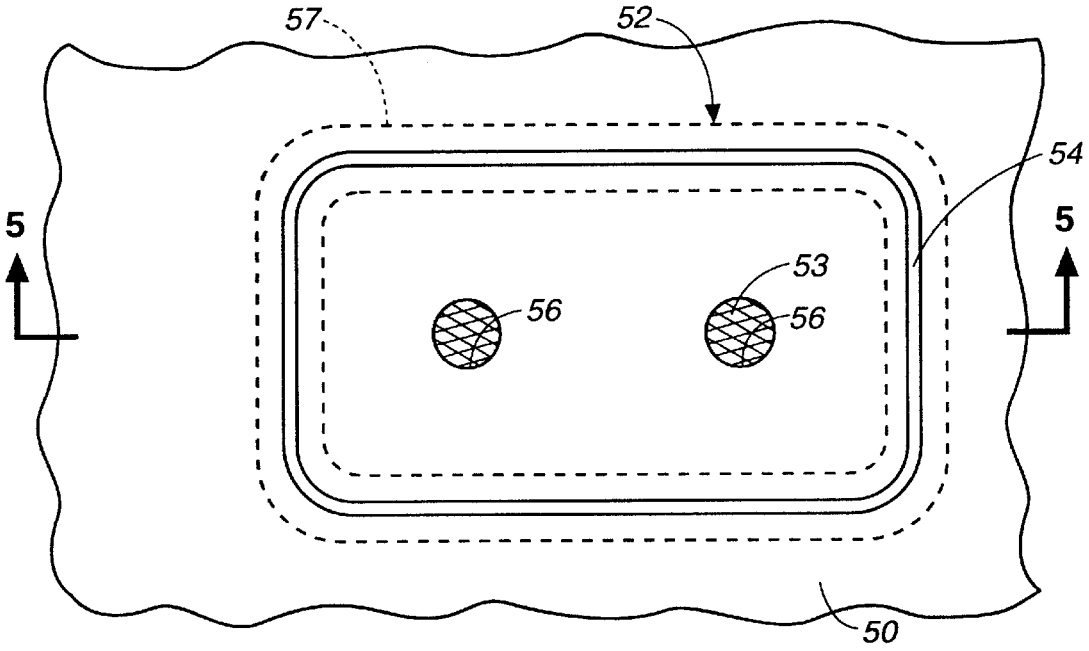
FIG. 4, is an enlarged, top plan view of a vent assembly suitable for use in the present wheelchair seat assembly.
Figure 5:
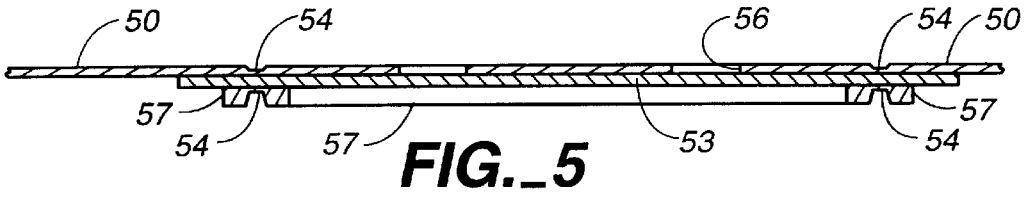
FIG. 5 is a front elevation view, in cross section, of the vent assembly of FIG. 4, taken substantially along the plane of line 5—5 in FIG. 4.

As best may be seen in FIGS. 4 and 5, envelope 50 is further preferably formed with at least one vent assembly 52, which allows air in foam member 30 to escape through envelope 50 during compression of the foam cushion under the user's weight. In the preferred form of vent assembly 52, a hydrophobic cloth 53 is heat sealed at 54 across die cut openings 56 in envelope 50. An annular second sheet 57 of polyether polyurethane is provided underneath the hydrophobic cloth so that heat sealing forms a sandwich between envelope 50 and frame sheet 57 which traps the vent cloth therebetween. The hydrophobic cloth, for example, a polyester knit, will breath and allow air to exit envelope 50 and then allow air to return when the foam is no longer compressed. This form of vent also prevents the urethane from self-sealing and dampens any associated vibration and noise. Vent 52 is most preferably positioned in a downwardly facing surface of the envelope in an area not against seat pan 12, for example, as shown in FIG. 3 superimposed over cut-out or relieved rear edge 22 of the seat pan. The downwardly facing orientation and hydrophobic cloth reduces the likelihood that liquid will enter the foam member through vent assembly 52.

Finally, seat assembly 21 preferably includes a cover 60 formed of a hydrophobic material which can provide a more comfortable interface between the user and the seat assembly than sitting directly on elastomeric envelope 50. Cover 60 can be of the type in widespread use in the seating industry, for example, a shower cap-like cover which has an elastic member therein proximate the periphery of the cover. Cover 60 extends over the side edges 27, 28 of the seat pan 12 and the elastic holds the cover in place. optionally, cover 60 may have openings through which the mounting assembly or clips 24 extend.

Having described the preferred embodiment of seat assembly 21 of the present invention, the method of the present invention can also be set forth. In the wheelchair seating system of the present invention, the user is supported by the steps of providing a relatively rigid and contoured thin seat base or pan 12. The seat base or pan is preferably anatomically contoured on its upper surface 14 so as to influence the lateral stability in positioning of the user on the seat assembly. Next, the present method includes the step of mounting a relatively soft and flexible foam cushion member 30 on seat pan 12 so that the user's weight will cause the foam member to conform to the contours in the seat pan without bridging. Moreover, the contours of the seat pan are communicated through the soft foam to the upper surface of the foam so as to be effective in influencing the positioning and posture of the user on the seat assembly. In the most preferred aspect of the method of the present invention, the step of providing an elastomeric envelope 50 over the soft foam member is taken, with the surface area of the envelope in the ischial/coccyx region being substantially greater than the foam area of cushion 30, and any inserts, supporting the user's ischial/coccyx region. The present method also preferably includes the step of mounting a pressure distributing fluid pouch 40 in a semi-collapsed condition on top of foam member 30 and under elastomeric envelope 50 in the area which supports the ischial tuberosities and coccyx of the user. The fluid pouch may advantageously be mounted in a recess 38 in the foam cushion and/or may be attached to the underside of envelope 50 to retain its transverse position.

Accordingly, in the method of the present invention, a rigid seat pan and flexible soft foam, together with an elastomeric envelope, and preferably a ischia support insert, are all mounted together to give the user a highly stable, low-profile, lightweight seat assembly for a wheelchair.

What is claimed is:

1. The combination of a flexible pouch and elastomeric envelope for use in a wheelchair seating system comprising:

a) a flexible pouch having a flowable material contained therein, b) an elastomeric envelope mounted around a cushion of said seating system, said flexible pouch being fixed directly to said elastomeric envelope at a plurality of spaced locations generally preventing relative movement between said flexible pouch and said envelope, c) said flexible pouch being held in position on an area of said cushion by said envelope, and d) said envelope and said flexible pouch having mutually engaged surfaces superimposed on said area of said cushion, said superimposed surfaces each having areas greater than said area of said cushion permitting localized relative displacement between said surfaces and permitting movement of said flexible pouch and said superimposed area of said envelope relative to said cushion.

2. The combination of claim 1 wherein, said flexible pouch is divided into three compartments with each of said compartments containing a flowable material therein, said pouch being secured to said flexible envelope at a location positioning one of said compartments under each ischial tuberosities of a user and one of said compartments under a coccyx of a user when the user is seated on said seating system.

3. The combination of claim 2 wherein, said compartments are sealed from each other to prevent migration of said flowable material from one compartment to another.

4. The combination of claim 1 wherein, a plurality of side-by-side flexible pouches are secured to said elastomeric envelope to minimize transverse displacement relative to said elastomeric envelope.

5. The combination of claim 1 wherein, said flowable material is provided by microballoon-based thixotropic fluid.

6. The combination of claim 1 wherein, said elastomeric envelope and said flexible pouch are both composed of thermoplastic films, and said flexible pouch is heat sealed to an inside surface of said elastomeric envelope.

7. The combination of claim 1 wherein, said elastomeric envelope has a surface area over a top of said flexible pouch greater than the surface area of said flexible pouch thereby reducing shear stresses by maintaining said elastomeric envelope in a loose condition when a user is seated thereon.

8. The combination of claim 1 wherein, the bottom side of said elastomeric envelope has at least one air vent.

9. The combination of claim 8 wherein, said air vent is comprised of a layer of breathable material contained between layers of an elastomeric material on each side.

10. The combination of claim 9 wherein, said layer of breathable materials comprises a breathable fabric.

11. The combination of claim 1 wherein, a hydrophobic polyester fabric cover is mounted over said elastomeric envelope.

12. The combination of claim 1 further comprising:

a relatively soft foam member also contained within said elastomeric envelope, said soft foam member being sufficiently soft and flexible for localized deformation of said foam member under a user seated thereon.

13. The combination of claim 12 wherein, said soft foam member has an anatomically contoured top surface.

14. The combination of claim 12 wherein, said soft foam member has a contoured bottom surface.

15. The combination of claim 12 wherein, said elastomeric envelope has contoured top and bottom surfaces formed to mate with an area of each of said top and bottom surfaces of said soft foam member.

16. The combination of claim 12 wherein, said soft foam member has a recess therein located proximate a rear edge thereof to receive the ischia region of a user seated thereon; and said flexible pouch is received into said recess.

17. The combination of claim 15 wherein, said flexible pouch is larger than said recess in said soft foam member.

18. The combination of claim 11 wherein, said elastomeric envelope is water impervious and substantially surrounds said soft foam member to resist moisture entry into said soft foam member.

19. The combination of claim 18, and a fabric cover mounted over said elastomeric envelope.

20. A seat cushion comprising:

a resiliently displaceable foam member having a configuration suitable for use as a seat cushion and having a foam area provided for resilient support of a user's ischial tuberosities and coccyx when seated on said seat cushion;

at least one flexible pouch mounted in superimposed relation over said foam area, said pouch having a flowable material contained therein, and said pouch having a pouch area greater than said foam area and being mounted in a semi-collapsed condition enabling relative movement between said pouch and said foam member while maintaining said pouch in a loose condition when said user is seated on said seat cushion; and an elastomeric sheet mounted over an upper surface of said foam member, said elastomeric sheet having a sheet area superimposed over said foam area and said pouch, said pouch being fixed directly to said elastomeric sheet at a plurality of spaced locations to minimize relative displacement of said pouch and said elastomeric sheet outside said sheet area, said sheet area being greater than said foam area and said pouch, thus maintaining said sheet area in a loose condition and enabling relative movement between said sheet area and said pouch when the user is seated on said seat cushion.

21. The seat cushion as defined in claim 20 wherein, said elastomeric sheet is provided by an elastomeric envelope, and said elastomeric envelope encircles said foam member to maintain said sheet area in superimposed relation over said foam area.

22. The seat cushion as defined in claim 20 wherein, said elastomeric sheet is thermo-formed to provide said sheet area greater than said foam area.

23. The seat cushion as defined in claim 20 wherein, said elastomeric sheet is provided by a substantially water impervious elastomeric envelope, said elastomeric envelope substantially encases said foam member to maintain said sheet area in superimposed relation to said foam area, and said elastomeric envelope is thermo-formed with a bulge at said sheet area to provide a greater sheet area than said foam area.

24. The sheet cushion as defined in claim 20, and at least one flexible pouch mounted between said foam area and said sheet area, said pouch having a flowable material contained therein, and said pouch having a pouch area greater than said foam area and being mounted between said foam member and said elastomeric sheet in a semi-collapsed condition enabling relative movement between said pouch and said foam member and said pouch and said elastomeric sheet while maintaining said pouch in a loose condition when said user is seated on said seat cushion.

25. The seat cushion as defined in claim 24 wherein, said foam member is formed with a recess in an upper surface thereof positioned for support of the user's ischial area, and said pouch is positioned in said semi-collapsed condition in said recess.

26. The seat cushion as defined in claim 25 wherein, said elastomeric sheet is provided by an elastomeric envelope encircling and substantially containing said foam member and said pouch therein, and said pouch is secured to said elastomeric envelope.

27. The seat cushion as defined in claim 26 wherein, said elastomeric envelope has a thermo-formed area providing said sheet area greater than said foam area, and said pouch is thermally bonded to said elastomeric envelope in an area proximate a periphery of said thermo-formed area.

28. The seat cushion as defined in claim 20 wherein, said elastomeric sheet is provided by an envelope encircling and containing said foam member and said pouch therein.

29. The seat cushion as defined in claim 28 wherein, said foam member is formed with a recess therein at said foam area; and said pouch has an area greater than said recess and is mounted in said semi-collapsed condition in said recess.

30. The seat cushion as defined in claim 28 wherein, said envelope is thermo-formed to have a bulge therein providing said sheet area.

31. A method of maintaining the position of a foam cushion relative to a fluid pouch for use in a seat assembly comprising the steps of:

securing said fluid pouch to a flexible envelope;

at least partially enclosing said foam cushion by said envelope with said fluid pouch disposed between said cushion and said envelope; and wherein said step of securing includes providing the fluid pouch and a portion of said envelope adapted to superimpose the cushion and the pouch with respective mutually facing surfaces of greater area than the portion of said cushion they superimpose, and fixing said fluid pouch directly to said envelope at a plurality of spaced locations to minimize relative displacement between the pouch and the envelope while permitting transverse shifting of the pouch and said portion of said envelope relative to said cushion.

32. The method of claim 31 wherein, said securing step is accomplished by bonding said fluid pouch to an inner side of said envelope; and said mounting step is accomplished by mounting said envelope on said foam cushion with said fluid pouch therebetween.

33. The method of claim 31 wherein, said fluid pouch and said envelope are both formed of thermoplastic materials, and said securing step is accomplished by thermally bonding said fluid pouch to said envelope.

34. The method of claim 31 wherein, said mounting step is accomplished by mounting said envelope to a foam cushion having a recess in a surface thereof, and during said mounting step, positioning said fluid pouch in said recess and between said envelope and said foam cushion.

35. A method of supporting a user on a seat assembly in a wheelchair comprising the steps of:

mounting a relatively rigid seat base of a single thin and uniform thickness solely supportingly and spanning and resting on top of spaced apart side seat frame members of said wheelchair, said seat base being anatomically contoured to distribute the user's weight and stabilize the user's posture on said seat assembly, and said seat base being formed to extend continuously from a position on top of said wheelchair seat frame members inwardly and downwardly to a position below said seat frame members over a majority of a width dimension thereof; and mounting a relatively soft cushion assembly over said seat base, said cushion assembly being sufficiently soft for communication of contours on said seat base through said cushion assembly to said user.

36. The method as defined in claim 35 wherein, said mounting step is accomplished by mounting an anatomically contoured cushion assembly over said seat base whereby contours in said cushion assembly and contours in said base cooperate to distribute weight and stabilize the user.

37. The method as defined in claim 35, and further including the steps of:

prior to said mounting step, containing said foam cushion assembly in an elastomeric envelope; and mounting a flexible fluid-filled pouch between said elastomeric envelope and said foam cushion assembly.

38. The method as defined in claim 37 wherein, prior to said step of mounting a flexible fluid-filled pouch between said elastomeric envelope and said foam cushion assembly, securing said pouch to an inner surface of said elastomeric envelope.

* * * * *